United States Patent [19]

Prengaman et al.

[11] 4,373,654

[45] Feb. 15, 1983

[54] METHOD OF MANUFACTURING ELECTROWINNING ANODE

[75] Inventors: Raymond D. Prengaman, Arlington; James L. Howard, Grand Prairie, both of Tex.

[73] Assignee: RSR Corporation, Dallas, Tex.

[21] Appl. No.: 211,435

[22] Filed: Nov. 28, 1980

[51] Int. Cl.[3] ..... B23K 31/02; B23P 17/00; C25C 7/02

[52] U.S. Cl. ..... 228/173 R; 29/825; 29/879; 204/286; 204/293; 228/179; 228/901

[58] Field of Search ..... 204/286, 288, 289, 293; 29/879, 825; 228/901, 179, 173 R; 429/225

[56] References Cited

U.S. PATENT DOCUMENTS

| | | | |
|---|---|---|---|
| 2,666,029 | 1/1954 | Quasie et al. | 204/286 |
| 2,723,230 | 11/1955 | Godsey, Jr. | 204/286 |
| 2,776,939 | 1/1957 | Newton | 204/286 X |
| 2,848,411 | 8/1958 | Hartzell | 204/286 X |
| 3,298,945 | 1/1967 | Weis et al. | 204/286 X |
| 3,530,047 | 9/1970 | Billett | 204/286 X |
| 4,282,082 | 8/1981 | Cook et al. | 204/286 X |

FOREIGN PATENT DOCUMENTS

| | | | |
|---|---|---|---|
| 2415032 | 10/1974 | Fed. Rep. of Germany | 429/225 |
| 2001347 | 1/1979 | United Kingdom | 204/286 |

*Primary Examiner*—Donald R. Valentine

[57] ABSTRACT

A lead anode for electrowinning metals from sulfuric acid solutions is formed by soldering a sheet of lead anode material endwise in a slot, which extends longitudinally along and partially through a lead alloy coated copper bus bar and into which the sheet fits tightly, and thereafter depositing lead alloy filler at all joints between the bar and anode. Anodes thus constructed have a uniform, smooth joint between the bar and sheet and thus are corrosion resistant and exhibit uniform conductivity.

2 Claims, 5 Drawing Figures

METHOD OF MANUFACTURING ELECTROWINNING ANODE

BACKGROUND OF THE INVENTION (a) Field of the Invention

This invention relates to lead anodes for electrowinning metals from sulfuric acid solutions and to a method of manufacturing such anodes.

(b) State of the Art

Lead anodes have been used for years in electrowinning of copper, nickel, zinc, and other metals. In the use of lead alloys for electrowinning of metals from sulfuric acid solutions, the lead becomes an insoluble, stable anode. The property of lead which accounts for this use is the ability of lead to form an insoluble corrosion film which can repair itself if damaged and prevent further corrosion of the lead anode. In sulfuric acid, an initial thin lead sulfate corrosion layer is converted via the applied current to lead dioxide by anodization. The oxygen generated at the anode during electrowinning reacts with the lead to form lead dioxide and converts lead sulfate to lead dioxide. For optimum performance of the anode, the alloy should form a thin, hard, dense, compact, adherent layer of lead dioxide on the surface. Such a layer will not spall off, deteriorate or contaminate the cathode product.

Conventional lead anodes are cast to shape with the cast lead convering a copper bus bar. This method of attachment uses excess amounts of lead, produces a wide anode because of the lead covering over the copper bus bar, and often gives poor contact between the lead and copper bar. In addition, since the lead must flow around the bar in casting, dross and air are often trapped in the area of the bus bar limiting conductivity and giving potential areas for corrosion or shorting. A conventional method of anode manufacturing is described in U.S. Pat. No. 4,124,482.

An anode of wrought lead-calcium-tin alloy in sheet form has also been employed in recent years for electrowinning metals from sulfuric acid solutions. Such sheet anodes have simply been bolted or otherwise mechanically attached to the bus bar.

A new improved means for attaching a metal sheet to a bus bar has now been discovered. The resulting anode has a uniform, smooth transition joint between the bus bar and sheet material and thus exhibits better conductivity and greater corrosion resistance than conventionally cast or mechanically fastened lead anodes. Moreover, the anodes of the invention can be of thinner construction than conventional anodes.

SUMMARY OF THE INVENTION

The present invention provides improved lead anodes for electrowinning metals from sulfuric acid solutions and a method for making such anodes. The anodes comprise a sheet of lead material suitable for electrowinning tightly disposed endwise and soldered in a longitudinal slot in a copper bus bar coated with an alloy containing a metal bonding agent and sufficient lead to inhibit corrosive attack on the bar.

DETAILED DESCRIPTION OF THE INVENTION

Figure 1:
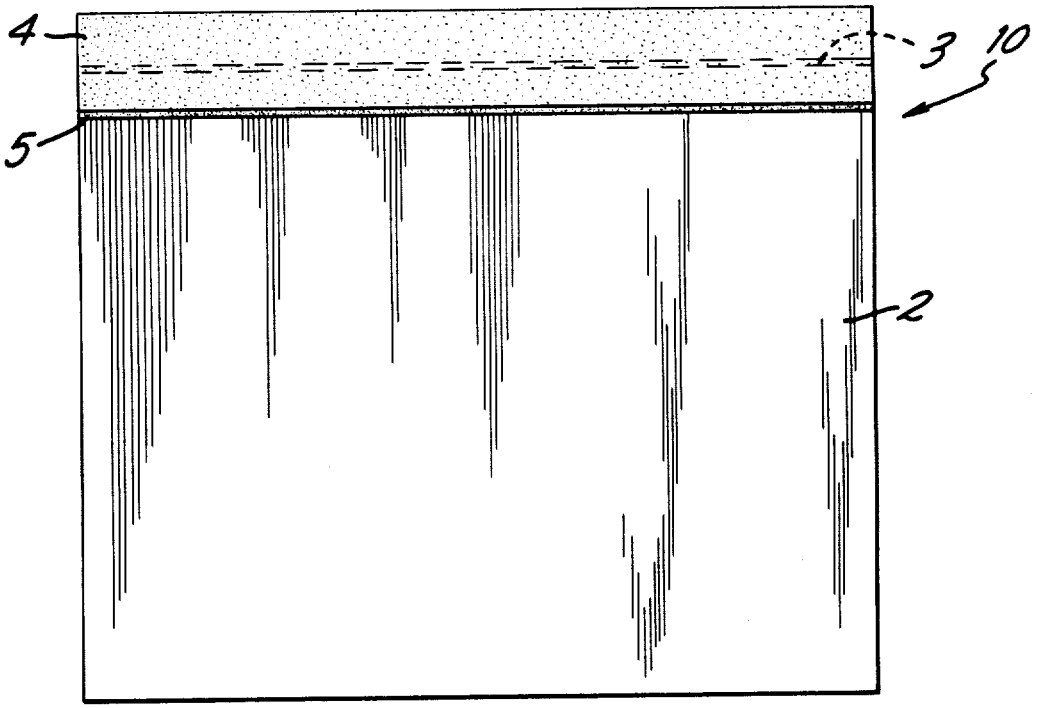
FIG. 1 is a side view of an anode of the invention.

The anode of the present invention comprises a sheet of lead alloy material tightly fitted endwise in a slot in a lead alloy coated copper bus bar. The anode is useful in electrowinning metals, such as copper, lead, tin, nickel, zinc and manganese from sulfuric acid electrolytes. Anodes of the invention have a tight, uniform and smooth bar/sheet joint. The anodes of the invention therefore exhibit greater corrosion resistance and more uniform conductivity than cast or mechanically attached anodes which have a less exact fit between anode material and bus bar. Moreover, the anodes of the invention may be of thinner construction than such conventional anodes thus permitting a greater number of anodes in a cell.

In accordance with the invention, lead alloy anode material used in electrowinning is formed as a sheet. The conventional square or rectangular copper bus bar is replaced by a longitudinally slotted or grooved copper bus bar which is coated with an appropriate lead alloy. The slot or groove is of a width and depth such that an end of the anode sheet fits tightly therein. Conversely one end of the lead anode sheet is formed to close tolerance to the slot. Small dimensional variations in the sheet can be removed by shaving.

The anode is constructed by fitting the properly sized end of lead anode sheet into the slot of the bar and soldering the bar and sheet together. The lead sheet may then be burned to the bar.

The lead sheet material employed in the anodes of the invention may be any lead alloy suitable for use in electrowinning. Such alloys include lead-silver, lead-calcium-silver, lead-antimony, lead-antimony-arsenic, lead calcium, lead-strontium-tin, lead-strontium-tin-aluminum, lead-calcium-strontium-tin and lead-calcium-tin alloys. The sheet may be formed by casting, extruding or rolling the alloy material. References to lead anode material herein are intended to include all lead alloys, however formed, which are suitable as anode material in electrowinning from sulfuric acid electrolytes.

The grooved copper bus bar is coated with lead alloy to prevent corrosive attack in use. This coating must contain sufficient lead, generally greater than 20 and often greater than 50 weight percent, to prevent excessive corrosion and consequent exposure of the copper to sulfuric acid fumes during electrowinning. Any such lead alloy containing sufficient additional metal component to bond the lead to the copper bar will be an effective coating material. A preferred coating material is a lead-tin-antimony alloy containing at least 50% lead, for example an alloy containing 52% lead, 45% tin and 3% antimony. The tin in this alloy serves to facilitate bonding of the lead in the coating to the copper. Where tin is the bonding agent generally it must comprise at least 1% of the alloy. In turn the lead serves to prevent corrosion of the copper bar. Finally, the antimony strengthens the alloy and aids corrosion resistance. Other lead alloys which can protect the bar from corrosive attack may also be employed as coating materials. Such lead alloy may contain other metals, such as silver or cadmium, as the bonding agents. Examples of other suitable alloys include lead-tin, lead-tin-silver, lead-cadmium and the like.

Coating of the copper bus bar may be effected after formation of the slot therein. Alternatively an ungrooved bar can be coated. The bar may then be grooved and thereafter the groove may in turn be coated. Regardless of the procedure employed, a uniform, protective coating should cover the entire bar for optimum corrosion resistance and longevity. With respect to the slot, the coating may be formed from a suitable solder described below or during the coating process itself.

The coated bar and sheet of lead anode material are fitted together by inserting the properly sized end of the lead alloy sheet anode into the slot. The bar and sheet are then joined by means of solder thereby producing a complete metallurgical bond between the sheet and bar. The solder is preferably a lead material containing tin or another material which imparts sufficient fluidity to the solder to allow penetration into the slot. Such penetration maximizes the contact between the bar and anode sheet, thus optimizing conductivity.

The solder material may be the same alloy used to coat the bar. In some cases a high melting point lead alloy solder may be used to prevent melting of the solder and dropping of the sheet from the slot if the anode experiences an upset condition and high temperatures during use. Preferred high temperature solders are low tin containing alloys such as ASTM B32 grade 2B or 5B or a lead-tin-silver solder alloy such as ASTM B32 grade 1.5S solder. These solders have very high melting points and are possible solder alloys when using high melting point lead anode sheet materials such as lead-calcium-tin alloys. For lower melting point lead alloys used as anode sheets, lower melting point solders may be used. In sum, preferred solder alloys include the coating alloy, a lead-low tin content alloy and a lead-tin-silver alloy.

The soldered lead anode sheet may then be burned to the copper bar at all joints to produce a uniform, smooth transition between the bar and sheet. The final burning operation is performed by puddling a filler alloy into all crevices. The filler alloy should bond to the solder, to the copper bar coating alloy and to the anode sheet. It should be of high lead content to give maximum corrosion protection to the joint areas and be fluid enough to fill all crevices and create a smooth transition joint between bar and sheet. Preferred filler alloys are: copper-bearing lead alloys, the bar coating alloy, a lead-antimony alloy, as for example lead-6% antimony alloy, a lead-low tin solder and lead-copper alloy.

A particularly suitable lead sheet material for use in the present invention is a wrought lead-calcium-tin alloy. This alloy should contain between 0.03% and 0.08% calcium and sufficient tin to produce at least a 0.11/1 calcium/tin weight percent ratio for optimum performance. The tin should additionally be limited to a maximum of about 2 weight percent for maximum mechanical properties. Maximizing the tin and/or calcium contents within the above limits increases the mechanical properties of the anode.

Such a lead-calcium-tin alloy is preferably formed into sheets by hot working. Such hot working may be effected by deforming a cast billet hot, preferably at temperatures above 150° C., to reduce or prevent the amount of precipitation of calcium and tin during the working. By keeping the calcium and tin in solution, the material can be worked extensively from large billets while the material is extremely soft and plastic. The deformation to final gauge may be done hot or cold depending on the desired properties and grain structure. The hotter the deformation, the lower are the final mechanical properties and the higher the elongation. Hot deformation, however, produces fewer stresses which might cause warping than cold working.

The tin in the lead-calcium-tin alloy improves the mechanical properties of the anode sheet. Specifically the tin increases strength, creep resistance and resistance to structural change due to temperature.

Deformation of a lead-tin-calcium alloy by rolling or extrusion produces a fine grained uniform structure throughout the wrought anode. Such uniform structure prevents differential corrosion due to grain size effects. Further, since grain size is reduced in rolling, corrosion of the wrought anode surface is more uniform.

In addition, during calcium-tin precipitates are deposited at uniformly spaced sites. The precipitates strengthen the lead. Moreover, these precipitates inhibit corrosion of the anode, by formation of calcium sulfate and stannic oxide during anodization to form lead dioxide on the anode surface. These insoluble materials serve as reinforcements for the lead dioxide reducing the chance of penetrating corrosion and early failure of the anode.

Finally, wrought lead-calcium-tin alloy anodes avoid structural defects encountered with cast anodes, such as trapped dross and porosity.

In sum, the uniform grain size, lack of voids or structural defects, uniform corrosion behavior and high strength combine to make wrought lead-calcium-tin sheets excellent materials for electrowinning metals from sulfuric acids. Furthermore, because of the high strength and structural integrity of wrought lead-calcium-tin sheets, anode sheets, thinner than cast sheets, can be formed therefrom. A greater number of anodes formed from such wrought sheets can thus be placed in a cell without concern for warping or deflection of the anode.

It must be emphasized that although the above described lead-tin-calcium alloy anodes are suitable for use in the invention any lead alloy effective for use in electrowinning may be employed. Such materials include commercially available lead-silver, cast lead-antimony-arsenic and lead-strontium-tin-aluminum alloys conventionally employed in electrowinning from sulfuric acid electrolytes. In general, the specific alloy material and its mode of formation into the anode sheet are matters of individual choice and preference according to the specific electrowinning conditions.

Figure 2:
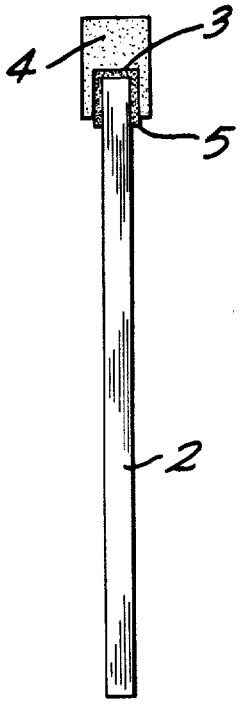
FIG. 2 is an end view of the anode of FIG. 1.

The anode of the invention can be constructed in various forms. With reference to FIG. 1, the anode 10 comprises a sheet of lead anode material 2 positioned end wise in slot 3 of lead-tin alloy coated copper bus bar 4 and joined to bus bar 4 by solder 5. FIG. 2 depicts an end view of the anode of FIG. 1.

Figure 3:
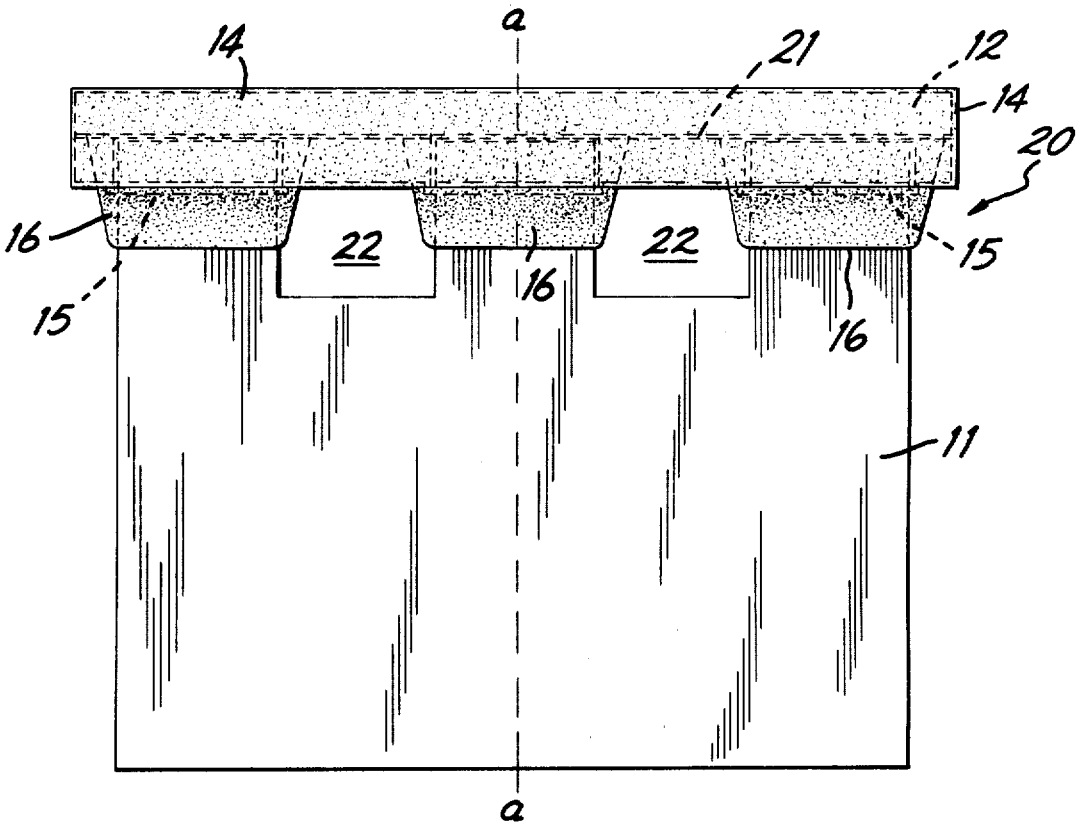
FIG. 3 is a side view of another embodiment of an anode of the invention wherein the lead anode sheet has recesses and has been burned to the bus bar.
Figure 4:
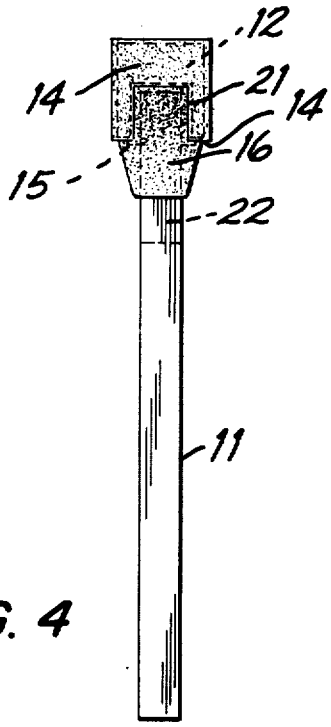
FIGS. 4 and 5 are an end view and a cross section respectively of the anode of FIG. 3.
Figure 5:
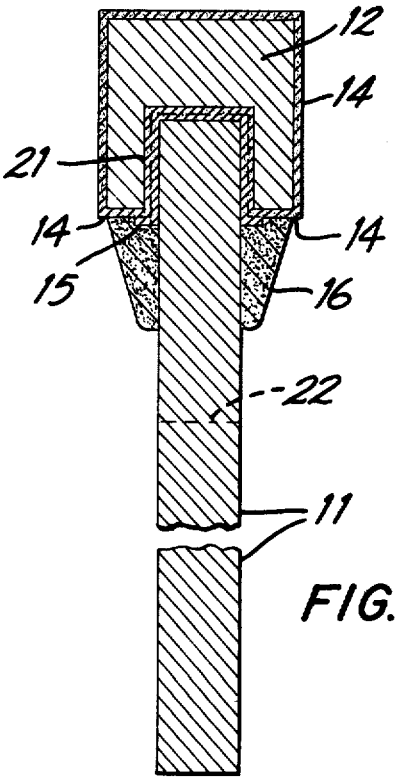

FIG. 3 illustrates an alternative embodiment of the anode of the invention wherein the anode 20 comprises a sheet of lead anode material 11 having one or more recesses 22 therein. Said sheet 11 is disposed in slot 21 of copper bus bar 12 which has a lead-tin alloy coating 14. The sheet 11 is joined by solder 15 to bus bar 12. Further the joints between sheet 11 and bus bar 12 have been burned together with deposits of lead alloy 16. FIG. 4 is an end view of the anode of FIG. 3. FIG. 5 is a cross section of the anode of FIG. 3 taken along line aa.

It is to be understood that the shape, dimensions and relative proportions of the sheet, bar and recesses of the anode of the invention need not conform to those shown in the drawings. Rather the size, shape and relative proportions of the anode's components may be adjusted as desired for a given electrowinning operation.

EXAMPLE

An anode was constructed from a slotted copper bar and a hot rolled lead-0.06% calcium-1.55% tin alloy sheet. The copper bar was $\frac{3}{4}'' \times 1\frac{3}{4}'' \times 46''$. A slot about $0.270'' \times \frac{1}{2}''$ was machined in the bar. The bar was precoated with an alloy of 52% lead-45% tin-3% antimony. A above rolled lead-calcium-tin alloy sheet $36'' \times 42'' \times 0.250''$ was inserted into the slot and soldered in place with the bar coating alloy. The joints, bar slot, and crevices between bar and anode sheet were filled by burning with a lead—6% antimony alloy.

What is claimed is:

1. A method of making a lead anode for electrowinning metals comprising:
   (a) forming a sheet of lead alloy anode material by hot working a billet of lead alloy at temperatures above 150° C. until uniform grain size is achieved;
   (b) forming a copper bus bar with a longitudinal slot of a size such that an end of the lead alloy sheet fits tightly therewith;
   (c) coating the bus bar with a lead-tin alloy;
   (d) fitting said end of the lead sheet into said slot of the coated bus bar; and
   (e) soldering the bus bar and lead sheet together.

2. The method of claim 1 wherein the lead alloy billet is a lead-calcium-tin alloy.

* * * * *